United States Patent [19]

Mitter

[11] Patent Number: 4,497,249

[45] Date of Patent: Feb. 5, 1985

[54] ARRANGEMENT FOR PREVENTING SCREEN DEFORMATION

[76] Inventor: Mathias Mitter, Falkenstrasse 57, Schloss Holte, Fed. Rep. of Germany

[21] Appl. No.: 393,881

[22] Filed: Jun. 30, 1982

[30] Foreign Application Priority Data

Jul. 17, 1981 [DE] Fed. Rep. of Germany ..... 3128324

[51] Int. Cl.[3] ..... B41L 13/06

[52] U.S. Cl. ..... 101/120; 101/127.1; 101/363; 400/662

[58] Field of Search ..... 400/203, 662; 101/210, 101/363, 114, 116, 117, 118, 119, 120, 123, 124, 126, 127, 127.1, 129

[56] References Cited

U.S. PATENT DOCUMENTS

| | | | |
|---|---|---|---|
| 17,340 | 5/1857 | Sanford | 101/122 |
| 542,497 | 7/1895 | Rehfuss | 101/120 |
| 746,786 | 12/1903 | Burdick | 101/122 |
| 866,624 | 9/1907 | Collier | 400/203 |
| 1,437,444 | 12/1922 | Post | 101/363 |
| 1,792,654 | 2/1931 | Neidich | 101/116 |
| 3,155,034 | 11/1964 | Reinke | 101/120 |
| 3,807,302 | 4/1974 | Kudlich | 101/363 |
| 3,998,157 | 12/1976 | Mitter | 101/122 |
| 4,392,426 | 7/1983 | Wege | 101/363 |

FOREIGN PATENT DOCUMENTS

| | | | |
|---|---|---|---|
| 836859 | 6/1960 | United Kingdom | 101/363 |

*Primary Examiner*—Clyde I. Coughenour
*Attorney, Agent, or Firm*—Peter K. Kontler

[57] ABSTRACT

A machine, particularly but not necessarily a screen-printing machine, has a rotary screen which is flexible and is liable to deformation out of its normal cylindrical shape. According to the invention an arrangement is provided which internally supports the screen against such deformation.

37 Claims, 14 Drawing Figures

FIG. 7
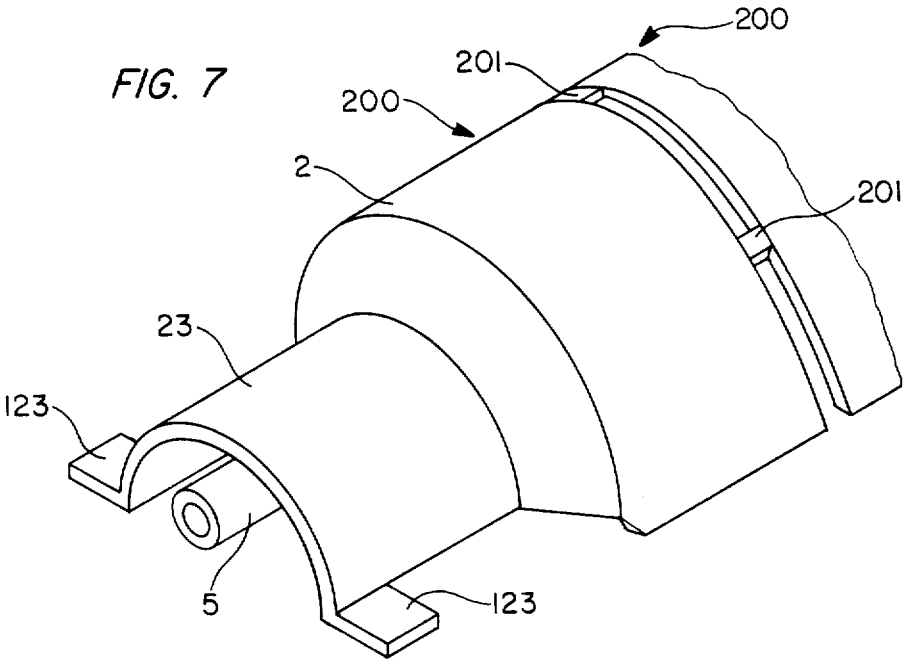
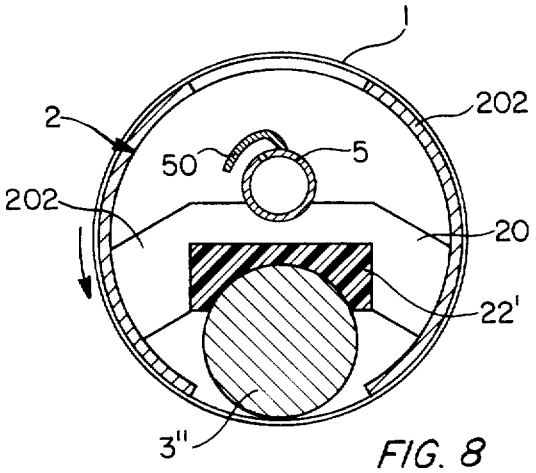
FIG. 8
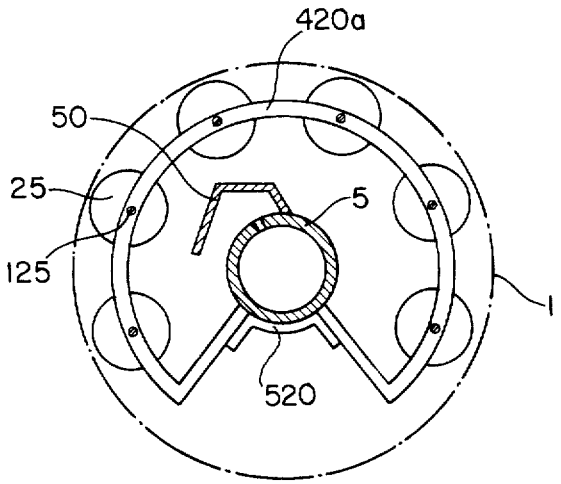
FIG. 10
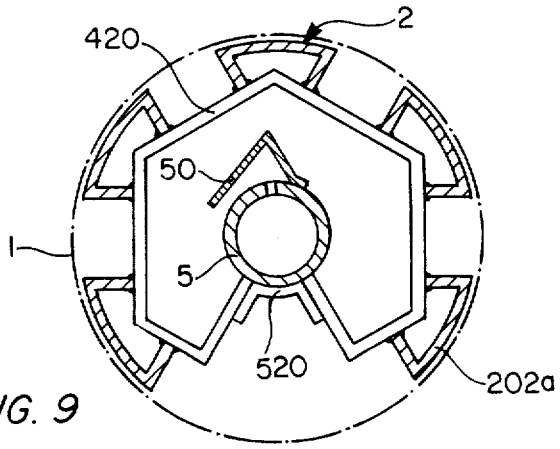
FIG. 9

ARRANGEMENT FOR PREVENTING SCREEN DEFORMATION

BACKGROUND OF THE INVENTION

The present invention relates to deformable rotary screens.

More particularly, the invention relates to deformable rotary screens of cylindrical configuration.

Still more particularly, the invention relates to deformable rotary cylindrical printing screens of the kind used, for example, in screen printing machines.

Printing screens of this kind are known and are quite widely used. They operate either continuously or discontinuously, being rotated relative to a workpiece to which they apply either a uniform color coating or which they print with a pattern having one or more colors. In the intermediate phases the screen is lifted off the workpiece. A great variety of different workpieces can be treated with such screens, and a particularly well-suited field has been found to be the printing (the term will be used herein for both patterned and non-patterned application of a flowable medium, such as for example printing ink, to a workpiece) of fibrous workpieces, such as smooth-surfaced or napped textiles, fibrous slivers and non-wovens. However, these screens can also be successfully used to print such workpieces as paper, synthetic plastic foils, and the like. The medium used for printing may be liquid ink, ink in form of paste, or a foamed treating medium. The medium need by no means be only a coloring agent, or to contain such a coloring agent; in may, instead, be or contain other agents such as are used for surface-coating the workpiece, or to fire-proof it, moth-proof it, enhance its "hand", impart gloss, etch the surface, or the like.

A problem encountered in the prior art, especially when relatively viscous media are to be applied to workpieces via screens of the type here under discussion, is that the weight of the medium sump which must be maintained within the confines of the screen (and which rests on the inner surface thereof, just ahead of the applicator device which forces medium from the sump through the screen and onto the workpiece), tends to deform the screen so that it loses its cylindrical roundness. This is undesirable for two reasons: it causes the screen to flex every time it performs a revolution and thus fatigues the screen material (usually metal) and it results in an inferior printing job due to uneven application of the medium to the workpiece. Further improvements in connection with the operation of such cylindrical screens are therefore clearly desirable but have, to date, not been forthcoming.

SUMMARY OF THE INVENTION

Accordingly, it is an object of the invention to overcome the problems experienced in the prior art.

A more particular object is provided an improved apparatus of the character herein described—for example, but not necessarily, a screen printing machine—having a screen of the type under discussion which is protected against the prior-art drawbacks.

Still more specifically, it is an object of the invention to provide a screen of the type under discussion which is provided with means for preventing the screen from being deformed out of its cylindrical roundness.

In keeping with these objects, and still others which will become apparent hereafter as the description proceeds, the invention resides in the provision of a rotary cylindrical printing screen which is liable to deformation out of its cylindrical shape, and support means located within the confines of the screen for preventing such deformation.

It is preferred at this time, although not absolutely necessary, for the deformation-preventing support means to extend over the entire working length (or width) of the screen, which is to say over the entire dimension over which the screen applies the flowable medium to a workpiece. The deformation-preventing means may have the medium-applying device (e.g. a squeegee, doctor blade or the like) integrated in it, but this is not necessary. In any case, however, the means must be so located and effective in such a manner as to counteract and prevent any out-of-round deformation of the screen under the weight of the medium pool or sump which rests on the inner surface of the screen, the latter being made of very thin metal or sometimes even of gauze. The gist of the matter is that the screen is to be maintained absolutely round in cross-section and over its entire length, or at least its entire working length.

The deformation-preventing means may be constructed in accordance with various embodiments. One of these proposes that the means be in form of a stationary tube or the like which is located within the space surrounded by the screen and has an outer periphery whose shape conforms to the shape of the inner circumferential surface of the screen, to which it is juxtaposed with just sufficient play (or yield) to avoid frictional damage. In the region where the medium is applied to the inner surface of the screen (to be forced through the screen by the applicator device and onto the workpiece), the tube has a free cross-sectional portion for passage of the medium. This stationary tube extends over the entire length of the screen and maintains the same in stabilized and perfectly round condition.

The use of a tube within a rotary screen has already been proposed in German Allowed Application DAS No. 2,543,394, albeit for a different purpose. In this application the tube acts as a carrier for a plurality of divider walls which subdivide the space between the tube and the inner surface of the screen. These divider walls rotate and reciprocate relative to the screen, in order to sweep the printing medium (located in the space between the tube and the screen) to and fro to keep it agitated and in good condition for sqeegeeing. The application itself states, in fact (in the last two lines of column 4) that these divider walls "have no supporting function, but only a delimiting function".

According to a further concept of the invention, the deformation-preventing means may be provided with reinforcing members, such as traverse members or the like; these may in particular hold the medium applying device, if so desired. Whatever their particular configuration, these reinforcing members may hold the applying device in a plane so as to prevent central hanging-through of the device during rotation of the screen. This, then, is in addition to the improvement which is already afforded according to the invention by the fact that the screen itself is stabilized against deformation out-of-round. Another advantage offered by the reinforcing members is the fact that the applicator device is held in the horizontal plane, so that hanging-through as a result of its own weight is also avoided. As already briefly indicated, the applicator device may be integrated into the deformation-preventing means, if so desired, and the supply tube for the flowable medium may be either carried by the deformation-preventing means or may also be integrated into the same.

Various kinds of applicator devices are known from the prior art and suitable for use in the present invention. For example, roller squeegees can be employed, as can be slot-type squeegees, carriers provided with nozzles which discharge the medium under pressure against the inner surface of the screen, or the like. In other words: any desired applicator device can be used, be it driven or passive, rotary or reciprocatory. All that counts, in accordance with the invention, is that the pressure acting upon the screen and tending to deform it out-of-round, irrespective of whether this pressure is exerted by the medium pool and/or by the applicator device, be prevented from effecting such out-of-round deformation of the screen.

The novel features which are considered to be characteristic of the invention are set forth in particular in the appended claims. The improved device itself, however, both as to its construction and its mode of operation, as well as additional features and advantages thereof, will be best understood upon a perusal of the following detailed description of specific although purely exemplary embodiments with reference to the accompanying drawing.

BRIEF DESCRIPTION OF THE DRAWING

FIG. 7 is a fragmentary perspective view, showing an embodiment of a reinforcing means;

FIG. 8 is a cross-sectional view illustrating a further embodiment with reinforcing means;

FIG. 9 is a view similar to FIG. 8 but showing still another reinforcing means embodiment;

FIG. 10 is analogous to FIG. 9 but showing another embodiment;

DESCRIPTION OF PREFERRED EMBODIMENTS

Figure 2:
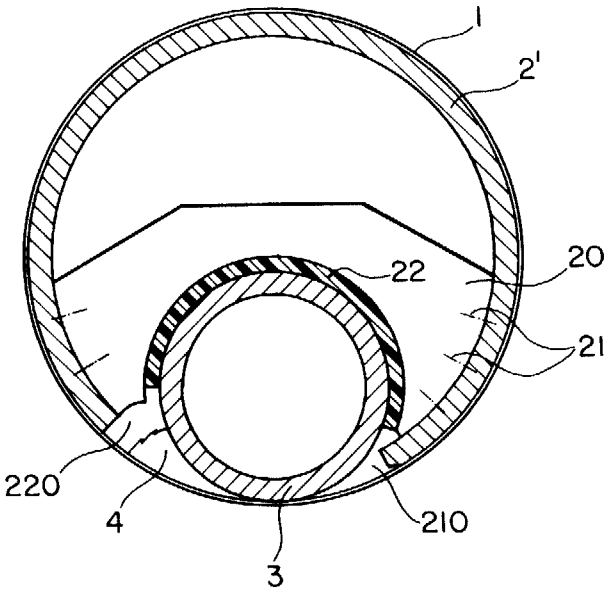
FIG. 2 shows the embodiment of FIG. 1, but with a rotary squeegee installed as the medium-applying device.

Before entering into a discussion of the various illustrated embodiments, it should be understood that the illustrations have been purposely kept simple, to concentrate on the inventive aspects. In particular, the screen has been shown only diagrammatically, being known per se in the art and therefore requiring no more detailed illustration. It is also emphasized that the end portions of the (cylindrical) screen can be constructed in any desired manner and can as well be journalled for rotation of the screen in any desired journals, all as already known from the prior art.

In most instances in the prior art it is customary for such cylindrical screens to be provided with end rings 10 (see FIG. 3) which hold and stabilize the end portions of the screen. Some constructions (and this is true of the one shown in FIG. 3) also have screen-tensioning devices (sleeves) 11 which axially tension the screen to prevent hanging-through; again, this is known from the prior art. Devices of this kind are disclosed, for example, in German Published Application DE-OS No. 2,026,492. However, other embodiments are also known from the art and suitable for use in the context of the present invention. Each end ring 10 may be coupled with its associated tensioning sleeve 11 which is in turn driven (known from the art) to rotate the screen about its longitudinal cylinder axis. Alternatively, either or both end rings 10 could themselves carry a drive gear 91 (FIG. 3) and be driven by a cooperating gear or pinion 90.

The screen itself is designated in all Figures with reference numeral 1 and is, as already repeatedly indicated, of cylindrical configuration. According to the invention, there is provided in the interior of the screen a deformation preventing support means 2, i.e. an arrangement whose function is to support the screen at the interior thereof against deformation to an out-of-round condition. It is advantageous for this arrangement to be open for passage of flowable medium in the region where such medium is being applied to the inner screen surface, for passage through the screen and into contact with the workpiece; the applicator device can then be arranged in such opening.

The deformation preventing means may, within the scope of the present invention, be constructed and embodied in various ways. In FIGS. 1–7, for example, it is in form of a stationary tube or pipe 2' the outer circumferential surface of which conforms in its shape to the inner surface of the screen 1, with which it is juxtaposed with just sufficient clearance so as not to undergo frictionally induced destruction during rotation of the screen. It should be understood, in this context, that the terms "tube" and "pipe" are being used merely for convenience and are not intended to be limiting. Perhaps the term channel-forming means might be more expressive of the true intent, since the tube or pipe 2' need not be circumferentially continuous, but may be of part-cylindrical shape, of segmental shape, or the like. Moreover, the element 2' need not be of one piece over the axial length of the screen 1, but may in this direction be composed of two or more individual parts which are connected with one another.

As illustrated—but not necessarily—the deformation preventing means 2 is provided in the region of application of the flowable medium to the inner surface of the screen 1, with an opening or free cross-section 210 in which an applicator device 3 is installed (or through which such a device, if not actually installed in the opening, has access to the inner screen surface). The device 3 may be separate from, or be integrated with, the means 2 and can—as already indicated earlier—be of any suitable type known from the prior art. For example, in the embodiment of FIGS. 1-6 the device 3 is a roller squeegee, but it could equally well be a doctor blade, a slot-type squeegee, a carrier having spray nozzles for the medium, or the like. Some of these alternatives will be discussed in more detail later.

In FIGS. 1-6 and 10 the deformation preventing means 2 is provided with reinforcing elements 20. These are spaced from one another lengthwise of the cylinder axis of the screen 1 and are connected to the means 2—i.e. here the pipe 2'—in a detachable manner, for example by means of screws (see #21). In the illustrated embodiments these members 20 are configurated as traverse members each of which is provided with a large recess or cut-out 120 shaped to accommodate the applicator device 3. In addition, allowance is made for the development and maintenance of a sump or pool of the flowable medium which is to be applied to the inner surface of screen 1 by the device 3, e.g. printing ink or the like. This is, in the embodiments under discussion, in form of a secondary cut-out 220 in each member 20, adjacent to and merging with the respective larger cut-out 120. The cut-outs 220 are located ahead (i.e. at the upstream side) of the device 3, i.e. at that side at which the flowable medium must be present in order for the device 3 to be able to squeegee it through the screen 1 and onto the (not illustrated) workpiece.

It is currently preferred to distribute the elements 20 over the entire length of the screen 1, as considered in the axial direction thereof; this corresponds to the length of the device 3 which also extends over the same dimension. A seal 22 may—but need not—be interposed between the outer circumferential surface of the device 3 and the inner surface portion bounding the cut-out 120 in the respective member 20. The applicator device, i.e. here the roller squeegee 3, could be frictionally driven by the screen 1 by virtue of its slight contact therewith, as is known from the prior art. Then again, it may have its own positive drive for rotating and, as shown in FIG. 3, the drives for the squeegee and the screen may be coupled with one another.

Figure 3:
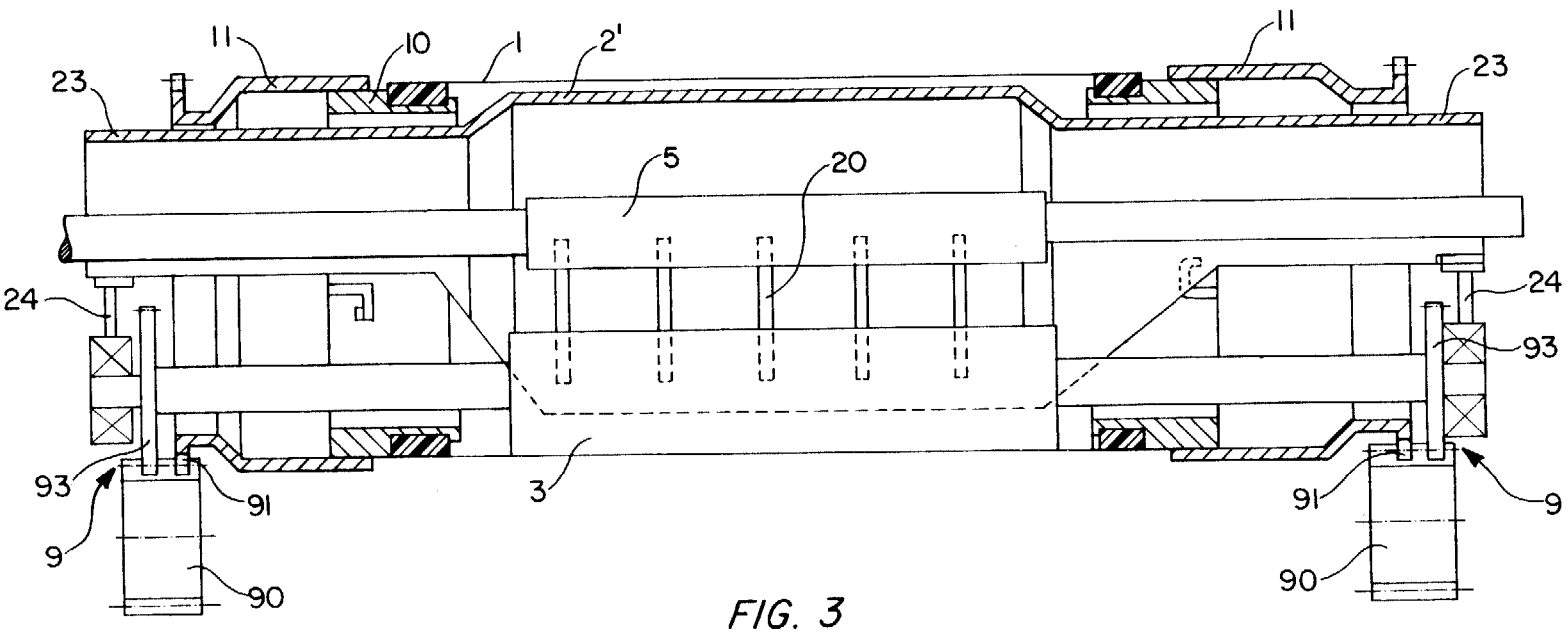
FIG. 3 is an axial section through the embodiment in FIG. 2.
Figure 4:
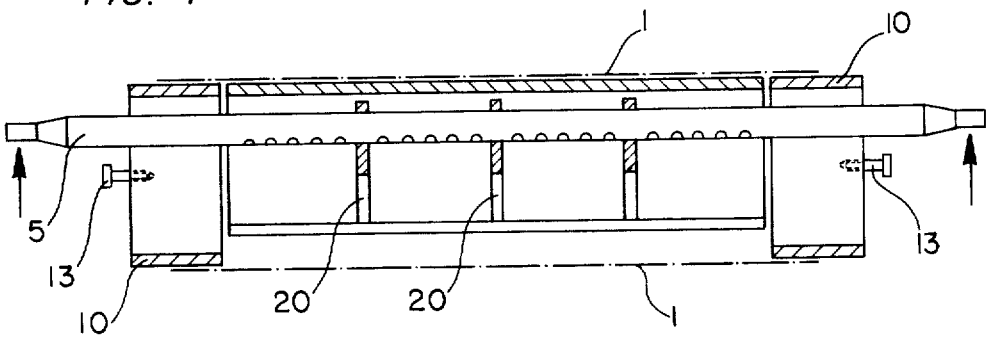
FIG. 4 is a view analogous to FIG. 3, but somewhat more simplified and illustrating another embodiment.

Turning to a description of FIG. 3, it will be seen that in this embodiment the screen 1 is supported at its end portions by end rings 10, as is already known from the prior art. The deformation preventing means is again in tubular form; in order to make it readily insertable into and removable from the interior of the screen 1, the cross-section of the tube end portions is reduced as compared to the center portion. These tube end portions form neck-like extensions 23 which extend through the end rings 10 and beyond the same outwardly of the axial ends of the screen 1. One or both (the latter being true of FIG. 3) end rings 10 are provided with a drive sleeve 11, i.e. a sleeve which is coupled with the respective end ring and carries a gear 91 which meshes with a drive pinion 90; in this manner, the screen 1 is rotated. The screen may be journalled within the respective drive sleeves 11 by (not illustrated) anti-friction bearings and the neck-shaped extensions 23 pass through the interior of the drive sleeves 11 to be, in turn, mounted and journalled in the lateral mounting heads (known from the prior art) of the machine. Of course, they could also be mounted on parts of the machine frame or the like and—again as known from the prior art—in such a manner as to be raised or lowered as the screen 1 itself is raised or lowered for purposes of adjustment, inspection or the like.

Figure 1:
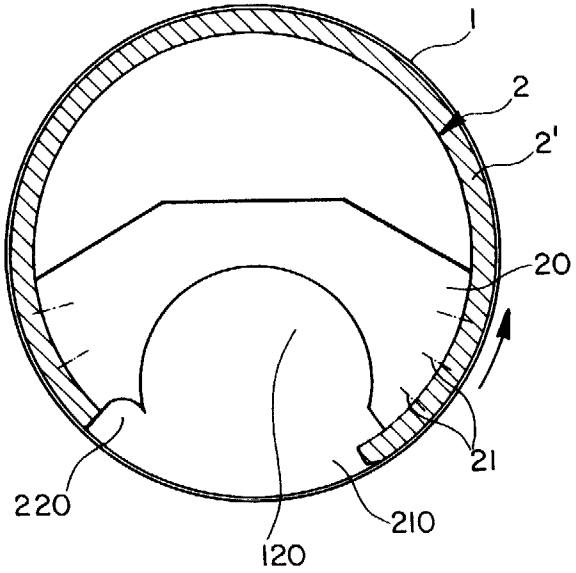
FIG. 1 is a somewhat diagrammatic view, illustrating a first embodiment of the invention.

Here, as in the preceding Figures, the means 2 is provided with reinforcing members 20 of the same type as discussed with reference to FIGS. 1 and 2. These hold the applicator device 3, also as in FIGS. 1 and 2; in addition, the members 20 of FIG. 3 also support a medium supply tube 5. Both the tube 5 and the axial end portions of the device 3 extend outwardly beyond the axial ends of the screen 1 (and past the end rings 10) to be journalled (or merely supported in the case of tube 5). Such journalling or supporting may take place separately from the arrangements for the screen 1, and arrangements may also be provided for varying the height-adjustment of the tube 5 and the device 3, separately from that of the screen 1.

As mentioned briefly before, it is possible to arrange the deformation preventing means 2 in such a manner that it can be height-adjusted by itself, i.e. independently of any such adjustments made to the screen 1. This possibility is illustrated in FIG. 3 where height-adjustable supports 24 are shown for the means 2, here in form of e.g. upright fluid-operated cylinder-and-piston units or the like. Of course, other types of devices are also suitable; for example, manually operated devices such as upright screw spindles could be used.

The end rings 10 and their respectively associated sleeves 11 are, in the embodiment of FIG. 3, connected with one another by bayonet closures or the like (any suitable releasable connection known from the prior art will serve the purpose), so as to be separable in order to allow the sleeves to be pulled off. Thereafter, it is merely necessary to remove one of the end rings 10 and the complete means 2 can then be axially pulled out of the screen 1. The drives for the screen 1 and the applicator device 3 (here a roller squeegee as already mentioned) are designated with reference numeral 9; their pinions 90 mesh not only with the previously mentioned gears 91 of the screen 1, but also with drive gears 93 of the squeegee roller 3.

In the embodiment shown in FIG. 4 the screen 1 is again supported by end rings 10; however, the sleeves 11 of FIG. 3 have been omitted in this illustration. The supply tube for supplying the flowable medium to the interior of the screen 1, is designated with reference numeral 5 again; however, in FIG. 4 this tube 5 is mounted so as to be height-adjustable (see the arrows which designate any of the height-adjustable devices mentioned in connection with the similar mounting of the means 2 in FIG. 3). The deformation preventing means is mounted on the tube 5 in the FIG. 4 embodiment, so as to be not only supported by that tube but also to be height-adjustable with the same. The tube and deformation preventing means are connected by the traverse members 20 (see e.g. FIG. 1) in cut-outs of which the tube 5 is releasably mounted (by means of e.g. screws or the like). Flowable medium is discharged from the tube 5 to the inner surface of the screen 1; exactly how this is done (e.g. via nozzles or holes in the tube, or in some other manner) is immaterial for purposes of the present invention; any manner known from the prior art is suitable. The end rings 10 are connected via bolts 13 to e.g. the not-illustrated sleeves 11 (as is known from the art). A particular advantage of this FIG. 4 embodiment is that it is not necessary to have end portions of the deformation preventing means extend out of screen 1 for mounting and journalling purposes.

Figure 5:
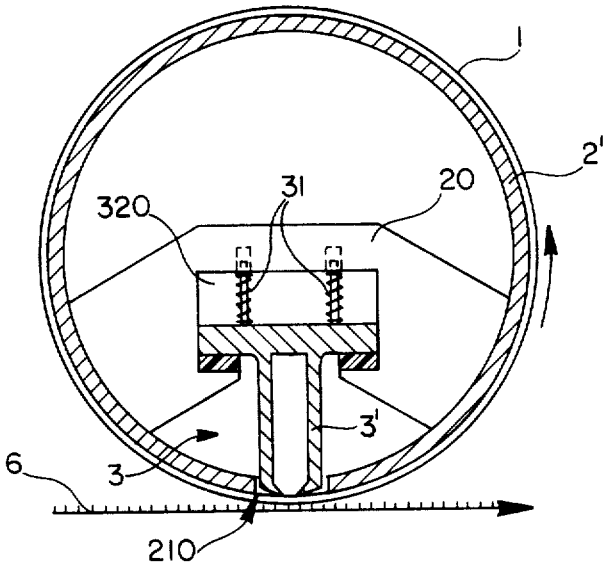
FIG. 5 is a view similar to FIG. 2, showing an embodiment provided with a slot-type squeegee as the applicator device.

FIG. 5 shows an embodiment of the invention in which the applicator device 3 includes a slot-type squeegee 3'. The deformation preventing means is here constructed again as a tube or pipe 2' as in FIG. 1 and can extend directly to the device 3. Pipe 2' has a free cross-section 210 as in FIG. 1, but of very narrow width, just sufficient to accommodate the outlet of the squeegee 3'. The squeegee 3' can be pressed firmly (see springs 31) against the lower portion of the screen 1; it is mounted in T-shaped arrangement, which is to say that it is received in cutouts 320 of the reinforcing members 20. The springs 31 are always located in the region of the respective member 20 and may be mounted and secured on bolts, as illustrated. Despite the relatively high pressure exerted by the spring-loaded squeegee upon the screen, it has been found that the screen 1 does not undergo deformation, certainly not in the region in which it is supported by the deformation preventing means.

Figure 6:
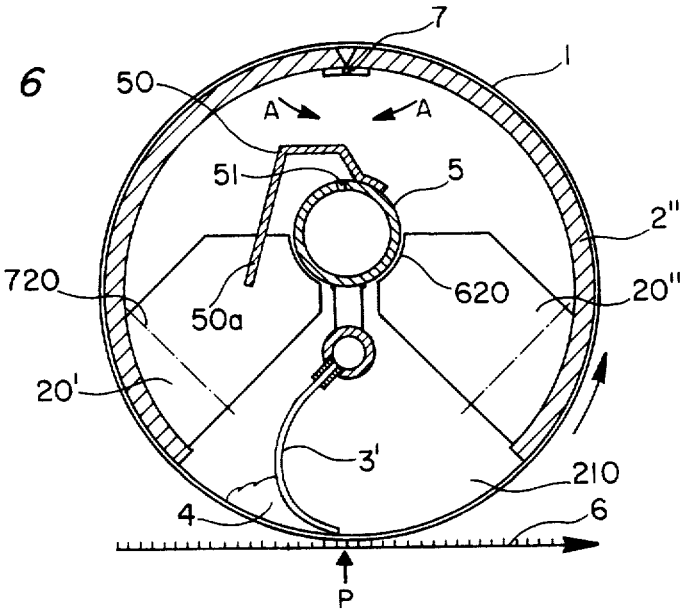
FIG. 6 is similar to FIG. 5, but showing an embodiment which utilizes a doctor blade as the medium-applying device.

FIG. 6 shows an embodiment in which the deformation preventing means—even though here again a generally tubular element 2" is used—can be removed from the screen 1 in a simple manner, namely by folding the element 2" in half (of course, it is also conceivable to make it fold in thirds, or in some other manner). In any event, in this embodiment the reinforcing means is not composed of unitary reinforcing members 20 as in the preceding embodiments, but instead uses (in place of each reinforcing member 20) a composite member having two sections 20' and 20". These are mounted on, and held in place by, the medium supply tube 5 which urges them apart and fixes them in their respective positions, so that they can perform their deformation preventing and reinforcing function. In this embodiment the medium outlet openings 51 of tube 5 are directed upwardly and a hood-like element 50 is mounted on the tube to intercept the medium issuing from the openings and to direct it downwardly against the screen 1. The tube 5 itself is pivotably received in bearing bushings 620 which are installed on the sections 20' and 20" for this purpose.

The applicator device here is mounted at the underside of the tube 5 and is in form of a flexible doctor blade 3'. Since in FIG. 6 the blade 3' is mounted on tube 5, which in turn is pivotable (the means for effecting such pivoting and the arresting of the tube in the selected position are located outside the screen 1 and have not been illustrated since they are known per se), the angle of contact between the blade 3' and the screen 1 can be adjusted at will by such pivoting of the tube 5. Of course, the embodiment of FIG. 6 is not limited to the use of a doctor blade as the medium applying device; other known devices can also be employed. The pool or sump of medium to be applied to the workpiece 6 is designated with reference numeral 4 and is located ahead of (i.e. upstream of) the doctor blade 3', as will be evident from the indicated direction of rotation (see the arrow) of screen 1.

The workpiece 6 itself can be guided past the screen 1 for application of the flowable medium in various ways. For example, it can be guided in a straight path, or it can be made to hug the screen 1 over part of the screen circumference, ahead of and/or behind the medium discharge point P. This is a decision left to the machine designer. The workpiece may be supported on a printing blanket, if desired, a counter-pressure member, or the like; a suction box, counter-pressure cylinder or the like. And, of course, as indicated before, many different kinds of workpieces can be treated with an arrangement according to the invention. The invention is, incidentally, of particular importance when a napped—especially a high-napped—workpiece is being printed or otherwise provided with flowable medium, since such workpieces require relatively great amounts of the flowable medium in order for the nap to be properly covered, so that the chances of screen deformation are very considerable without the means 2 of the invention.

The tube 2" in this embodiment is composed of two parts, as already indicated and clearly visible in FIG. 6. At the top these two parts are connected by a hinge 7 which extends lengthwise of the cylinder axis of the screen 1 and may be continuous or discontinuous, as desired. The point is that the two parts of tube 2" should be able to fold relative to one another (i.e. their edges bounding the cut-out 210 should be able to approach one another). This occurs when the tube 5 is raised within and relative to the screen 1. Such movement causes the free edge portion 50*a* of hood 50—which extends into slots provided for this purpose in the sections 20' (or in the sections 20" if the hood should be facing in the opposite direction from that illustrated) to retract upwardly out of these slots. The two halves of tube 2" can now fold by pivoting about hinge 7, whereby the diameter of tube 2" is reduced (see the arrows A) and the entire deformation preventing means can then be axially withdrawn from the screen 1 through one of the end rings 10 (not shown in FIG. 6). This very simplified possibility of removing the deformation preventing means is highly advantageous, since it greatly facilitates access to the interior of the screen 1 and the end rings 10, for inspection and e.g. cleaning when for example a change-over is to take place in the types of flowable medium, or in the color of printing ink. Of course, it also likewise facilitates access to the deformation preventing means itself, for the same purposes and/or for inspection or repair.

In the embodiment of FIG. 7 the deformation preventing means 2 again has a neck-like extension 23 as in FIG. 3. Here, however, the means 2 is composed of a plurality of individual sections 200 which are arranged sequentially, one behind the next, along the cylinder axis of the screen 1 (the screen is omitted in the illustration). Of course, the means 2 need not assume the illustrated configuration (i.e. part tubular), but could have a different shape as will be discussed with reference to some of the embodiments following hereafter. The individual sections 200 are connected by connecting webs or members 201 (which may have any desired and practicable length as considered in the longitudinal direction of the screen axis). The neck-like extension 23 may be provided with radially (or generally radially) outwardly extending lugs 123 which may rest upon (or be connected to or otherwise be engaged by) the mounting and/or height-adjusting device or devices provided for the means 2.

The embodiment of FIG. 8 shows that the means 2 may be composed of a plurality of ring-segments 202 which are held in place by the (here unitary) members 20. The applicator device is in form of a roller squeegee 3" mounted for rotation (the mounting means are outside the confines of the screen and not shown, being known per se) and in contact with respective seals 22' which are secured in cut-outs of the members 20. The tube 5 for supply of the flowable medium is mounted on (actually atop) the members 20 and provided with a hood 50, as in the embodiment of FIG. 6.

FIG. 9 is basically similar to FIG. 8, in that it also has a deformation preventing means 2 which is composed of relatively small ring-segments 202*a* which are arranged about the central longitudinal axis of screen 1, to form an annulus thereabout. In addition, of course, a series of such annuli is arranged in sequence along the screen axis, i.e. in direction normal to the plane of FIG. 9. All together, the segments 202*a* then form a generally tubular deformation preventing means having a wall which is interrupted both in circumferential and in longitudinal direction of the screen 1, but is nevertheless capable of preventing screen deformation in the desired manner.

In this embodiment the ring-segments do not cooperate directly with the tube 5, but instead cooperate with a cage-like mounting element 420 which surrounds the tube 5 with clearance and against which the ring-segments 202*a* are braced (and to which they may also be releasably or non-releasably connected with e.g. screws, welds or the like). The element 420 may be continuous in the longitudinal direction of the screen 1 (which is especially desirable if the screen 1 is very long in axial direction, i.e. if it has a great working width), or it may be discontinuous and in form of individual sections. The element 420 may be releasably or non-releasably connected with the tube 5 whose discharge openings face in upward direction and which is provided with a hood 50 for medium interception purposes, as discussed with reference to the FIG. 6 embodiment. A cage-supporting element 520 may also be provided and extend over the entire length of the cage-like structure 420, irrespective of whether the structure 420 is of one piece or made up of a series of individual parts which are arranged and spaced lengthwise of the screen 1. It may be releasably or non-releasably connected to the structure 420 and, if desired, the tube 5 can rest on it (as shown) or could even be secured to it alone, i.e. without the illustrated connection to the structure 420.

The embodiment shown in FIG. 10 resembles that in FIG. 9, in that it utilizes two or more (only one shown) cage-like structures 420*a* which are spaced from one another lengthwise of the screen 1. However, in FIG. 10 the actual deformation preventing function is performed by a series of rods or rollers 25 which are mounted in the structures 420*a*. It is currently preferred, but not absolutely necessary, that the rollers or rods 25 be journalled for rotation in the structures 420*a* for rotation about their respective axes 125. The supporting element 520 corresponds to the one in FIG. 9; it alone, or it in conjunction with the medium supply tube 5 (which again has the hood 50) may connect the two or more structures 420 together. The hood 50, incidentally, need not be of one piece in direction lengthwise of the screen 1, but may itself be composed of two or more longitudinally arranged (and connected or separated) parts. Just as in embodiments utilizing the members 20 such members may be of two sections which are hinged to permit them to be folded or which are otherwise foldable as in FIG. 6, so may the structures 420 be assembled of individual parts which are hinged to be foldable to permit easy extraction of the deformation preventing means from the screen 1 in axial direction of the same.

Figure 11:
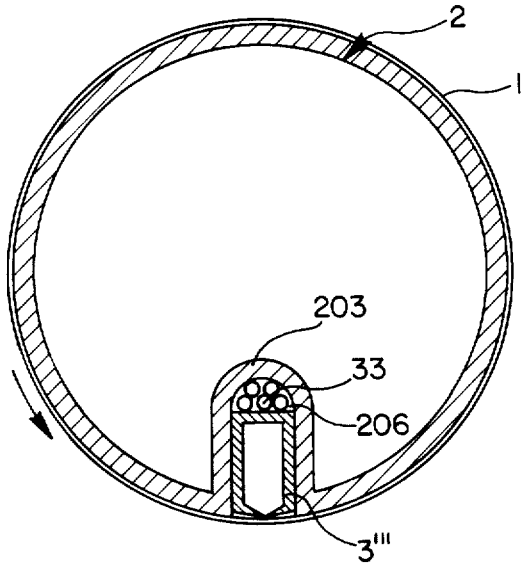
FIG. 11 is also similar to FIG. 9 but shows still a further reinforcing means embodiment.

Unlike the preceding embodiments, the one shown in FIG. 11 has a deformation preventing means 2 which, in the region of medium-application to the inner surface of the screen 1, is formed as a closed body 203 having an opening only to and in direction of, this region. In other words: the body 203—which is of course a part of the deformation preventing means 2—has no openings or other interruptions, either longitudinally or circumferentially of the screen 1 in this embodiment, although a modified version in which the body 203 might in fact be provided with such openings is not excluded from the concept of FIG. 11. In any event, as shown in FIG. 11 the body 203 has an interior 206 which accommodates a slot-type squeegee 3''' (known from the art; see also FIG. 5) as the medium applicator device. Interposed in the space between the squeegee 3''' and the upper wall-portion bounding the interior 206, is one or more (several illustrated in the Figure) distendable hoses 33 which, when distended by admission thereinto of a pressurized fluid, press the squeegee towards the screen 1 in order to establish therewith the good contact that is needed to assure proper passage of the flowable medium through the screen perforations.

It goes without saying that various modifications are possible in FIG. 11 within the scope of the invention. For example, the hoses 33 could be replaced by one or more springs or, indeed, any means suitable for effecting the desired biasing function. Also, the interior 206 may constitute a supply channel for such media as the flowable medium, gas, air, and the like. It could contain applicator devices or elements different from—or in addition to—the squeegee 3'''. The channel constituted by the interior 206 could conduct liquid, foamed or (as would be currently preferred for such a modification) viscous workpiece-treating media. Just for the sake of completeness it should be mentioned that the axial ends of the interior 206 are closed, so that the only opening from the interior to the screen 1 is the one through which the squeegee has access to the screen.

Figure 12:
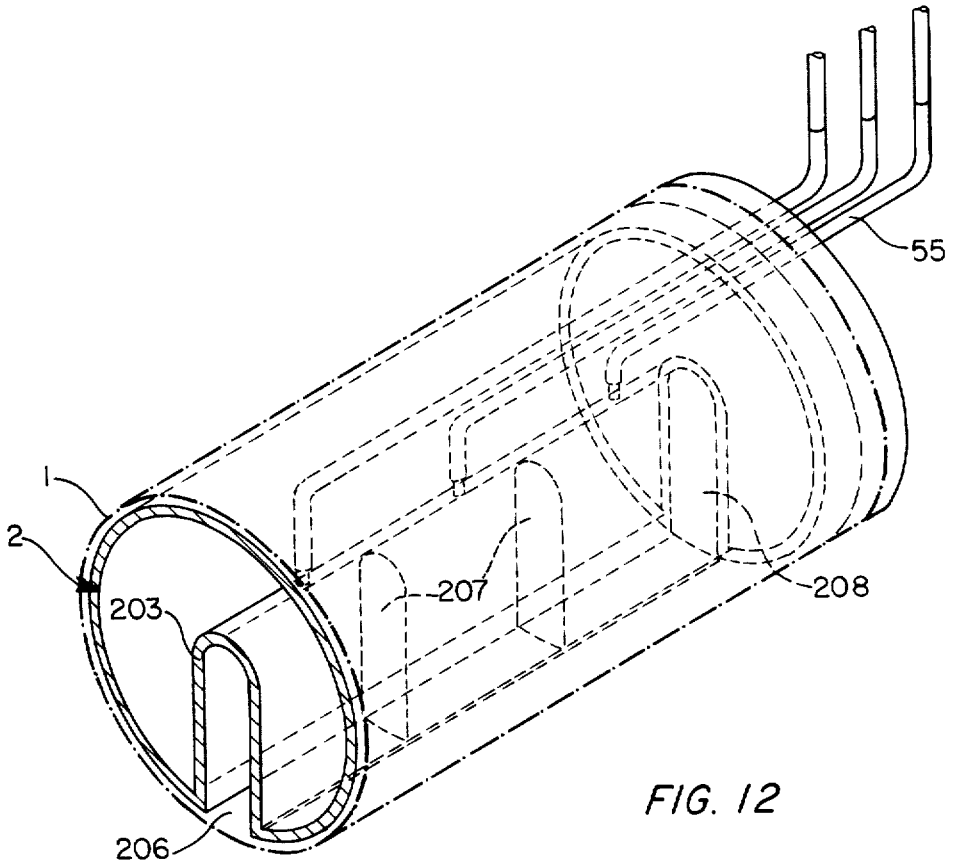
FIG. 12 is a somewhat diagrammatic perspective view of an embodiment having its medium applying device integrated with the deformation preventing means.

The concept in the embodiment of FIG. 12 is similar to the one shown in FIG. 11, in that again the deformation preventing means 2 has a closed body 203 provided with an interior 206 that is open only towards the inner surface of screen 1. The axial ends of the interior 206 are closed off again by end walls 208 (one shown). In this embodiment, however, hoses, tubes, pipes or other conduits 55 are provided which discharge flowable media (and/or other media, such as air or gas) directly into the interior 206. For example, each of the different conduits 55 could discharge a different flowable medium (such as a different color printing ink) to facilitate switching-over from printing with one color to printing with another. The interior 206 may be subdivided, in longitudinal direction of the screen 1, into two or more compartments by installation of partition walls 207 similar to the end walls 208. If so, each of the thus created compartments may communicate with, and be supplied by, a different one of the conduits 55, as shown in the Figure.

It will be evident that in the FIG. 12 embodiment the means 2 and the tube 5 (or the functions of the latter) are integrated with one another. The pressure exerted upon the screen 1 by the flowable medium (and against whose deformation tendencies the means 2 is to protect the screen), acts upon and is absorbed by the walls of body 203. Moreover, a desirable side effect of this pressure compensation is the fact that it will cause the screen 1 to more closely hug the means 2 at the side opposite the one where the pressure acts, thus improving the application of the medium through the perforations of the screen. In this embodiment a squeegee can be installed, similar to the one in FIG. 11; however, the functions of the squeegee may also be performed by the upstream edge portion of body 203 bounding the opening from interior 206 towards the screen 1, i.e. the right-hand edge portion if the screen 1 rotates in anti-clockwise direction.

Figure 13:
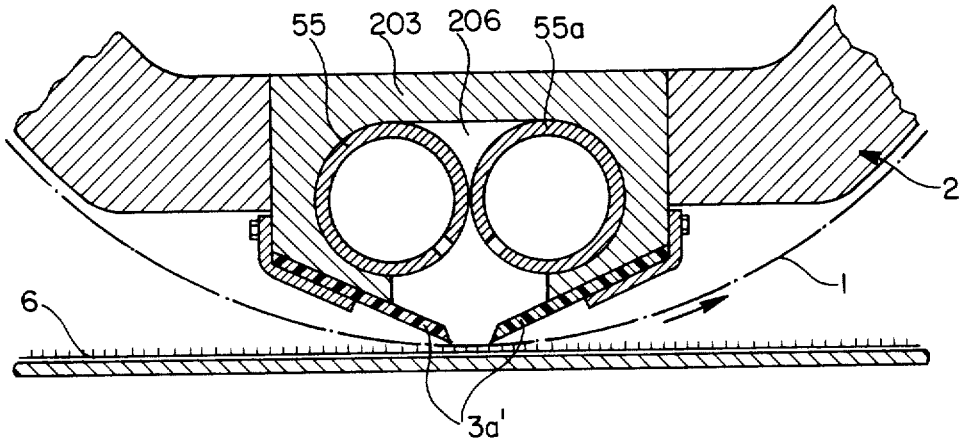
FIG. 13 is a fragmentary cross-sectional view, showing another embodiment with an integrated applicator device.

FIG. 13 illustrates an embodiment in which the means for supplying the medium is integrated with the means 2, i.e. this embodiment follows the basic concept of FIG. 12. The body 203 with its interior 206 is the same as in FIG. 12. Installed on the body 203, at the opening from interior 206 towards the screen 1, is an applicator device. In the illustrated embodiment this device is in form of elastic means or, to be more specific, in form of two flexible doctor blades 3*a*'. However, the embodiment is not limited to the use of this particular kind of applicator and, indeed, any known-per-se applicator suitable for the purpose can be used. The medium supply conduit or conduits 55 and 55*a* (two are shown) are here directly installed in the space 206, into which they discharge their medium. A particular advantage of this arrangement is that the medium can very easily be supplied at variable pressure.

Figure 14:
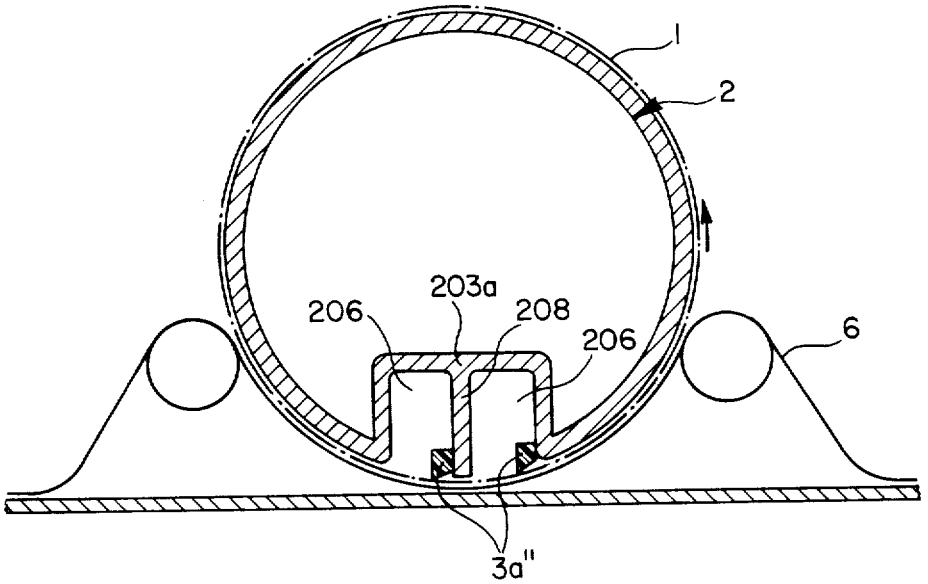
FIG. 14 is a complete cross-section through an embodiment having supply means for two media integrated with the deformation preventing means.

Finally, FIG. 14 shows an embodiment of the invention in which the means 2 again has a closed body or portion 203*a* which differs from the ones in the preceding embodiments only somewhat in its shape. The interior 206 of this body 203*a* is longitudinally subdivided by a divider wall 208, thus forming two side-by-side compartments. These serve as the medium supply conduits in the manner discussed with reference to the immediately preceding embodiments. In other words: in FIG. 14, as in these preceding embodiments, the tube 5 respectively the conduits 55, are integrated with the means 2. The channels or conduits 206 may both receive the same medium, or they may receive different media. For example, they may receive different-colored inks, colored printing foams (i.e. foamed inks), viscous pastes as the media to be applied to a workpiece 6 through the screen 1, or the like. Another possibility is to supply the different conduits 206 with media of different types and consistency, such as e.g. air into one and a gas into the other of the conduits.

As in the preceding embodiments, various kinds of applicator devices can be used in FIG. 14. A pair of doctor blades 3*a*" of bar-shaped configuration has been illustrated; however, many other possibilities exist, such as roller squeegees, even magnetically biased roller squeegees (known per se). If doctor blades are used and installed as illustrated, then it is advantageous to have the workpiece to be printed in surface contact with the screen 1 over part of its periphery. This can be accomplished as illustrated, by guiding the workpiece 6 over rollers or in another suitable way. The connections from the external supply or supplies of medium (or media) to the conduits 206 have not been illustrated but do, of course, exist and are known in the art for the supply of conventional ink-supply tubes. The medium or media can be supplied to the conduits 206 at adjustable pressure, if desired.

The preceding disclosure will make it evident that the concept of the invention can be embodied in a considerable variety of different ways. The gist of the invention, i.e. what really counts, is that the screen be prevented from undergoing deformation out of its originally perfectly round (circular cross-section) shape. This must be assured under the most varying operating conditions. As certain of the embodiments show it is possible and desirable—but not the primary inventive concept—to integrate the medium supply function with the means 2 and/or to utilize the means 2 as a mount for supporting the applicator device and other elements. Moreover, a variety of further modifications is possible beyond the illustrated embodiments. For example, in FIG. 12 it is not necessary to be limited to the illustrated transverse partition walls 207; the compartments created by the presence of these walls could be further subdivided by e.g. longitudinally extending walls. In FIG. 14 the number of conduits into which the interior 206 is subdivided, could be greater than the two conduits illustrated. The body 203 or 203*a* respectively the means 2 can constitute the guidance and support means for the respective applicator device. However, to repeat: what really counts is to protect the screen 1 from being deformed out-of-round under various operating conditions.

Without further analysis, the foregoing will so fully reveal the gist of the invention that others can, by applying current knowledge, readily adapt it for various applications without omitting features that, from the standpoint of prior art, fairly constitute essential characteristics of the generic and specific aspects of the inventive contribution to the art. Therefore, such adaptations should—and indeed are intended to—be comprehended within the meaning and scope of equivalence of the appended claims.

I claim:

1. In a machine for applying at least one flowable liquid medium to a workpiece which is disposed in a predetermined path, a combination comprising a flexible rotary endless cylindrical printing screen which is liable to deform out of its cylindrical shape having first and second ends; rigid end rings connected to the ends of the screen; stretch means for applying to said screen an axial stretching force by way of said end rings; means for rotating said screen about its axis by way of said end rings so that successive increments of the screen advance along a portion of said path; and support means located within the confines of said screen separate from said stretch means for preventing deformation of the screen, said support means being adjustable with respect to said stretch means and closely adjacent to but normally out of contact with the internal surface of said screen and being spaced apart from that portion of said screen which is adjacent to said portion of said path.

2. A combination as defined in claim 1, said support means comprising at least one stationary screen-supporting element.

3. A combination as defined in claim 2, wherein said element is a stationary tube.

4. A combination as defined in claim 2, said element having a wall provided with an outer surface facing an inner surface of said screen, said wall having at least one opening for permitting access of a flowable medium to said inner surface of said portion of said screen.

5. A combination as defined in claim 1, said support means comprising a plurality of stationary screen-supporting elements arranged in sequence lengthwise of said cylindrical screen.

6. A combination as defined in claim 5; and further comprising means for connecting said elements with one another.

7. A combination as defined in claim 6, said elements being configurated as ring-segments.

8. A combination as defined in claim 5, said elements being journalled rollers each having a periphery conforms in its shape to the shape of an inner circumferential surface of said cylindrical screen.

9. A combination as defined in claim 5, said elements being journalled rods each having a periphery conforming in its shape to the shape of an inner circumferential surface of said cylindrical screen.

10. A combination as defined in claim 1, wherein said support means includes reinforcing members.

11. A combination as defined in claim 10, said reinforcing members being traverse members or cage-shaped members or bars or in form of a solid reinforcing body.

12. A combination as defined in claim 10; further comprising applicator means for applying a flowable medium through said screen to a workpiece; and wherein said reinforcing members hold said applicator means in requisite position relative to said screen.

13. A combination as defined in claim 10; further comprising a tube for supplying a flowable medium to the interior of said cylindrical screen; and wherein said reinforcing members hold said tube in requisite position relative to said cylindrical screen.

14. A combination as defined in claim 10, said support means further including a plurality of stationary supporting elements arranged in sequence lengthwise of said cylindrical screen; and further comprising means for connecting said reinforcing members to respective ones of said elements, said reinforcing members being composed of connected sections which are foldable in relation to one another for insertion into, and removal from, the interior of said cylindrical screen.

15. A combination as defined in claim 1, said support means having a peripheral wall facing an inner circumferential surface of said screen and being provided with a larger opening adapted to receive an applicator device for applying a flowable medium to said inner surface, and with a smaller opening adapted to hold a sump of said medium.

16. A combination as defined in claim 1; further comprising a rotary applicator device within the confines of said screen for applying a flowable medium to an inner surface of the screen; and sealing means interposed between and establishing a seal with said device and said support means.

17. A combination as defined in claim 1, said support means including reinforcing members spaced lengthwise of said cylindrical screen over the entire working length thereof.

18. A combination as defined in claim 1; and further comprising height-adjustable journalling means for said support means and said screen, respectively, said journalling means for said support means being located outside of and adjacent to respective axial ends of said screen and being height-adjustable together with said screen.

19. A combination as defined in claim 1; further comprising support rings supporting respective axial end portions of said screen; and antifriction bearings mounting said support rings rotatably on said support means.

20. A combination as defined in claim 1; further comprising a supply tube for a flowable medium extending through and outwardly beyond the respective axial ends of said screen; means mounting said tube outside said screen for positional adjustment relative thereto; and wherein said support means comprises reinforcing members connected to said tube so as to be positionally adjustable therewith.

21. A combination as defined in claim 1; and further comprising a slot-type squeegee located within said screen for applying a flowable medium through the screen to the workpiece; and mounting means yieldably mounting said squeegee relative to said screen.

22. A combination as defined in claim 1, said support means having a peripheral wall which is continuous over the entire inner circumference of said cylindrical screen with the exception of an opening for admitting the flowable medium to an inner surface portion of the screen adjacent to said portion of said path.

23. A combination as defined in claim 1; further comprising a slot-type squeegee located within the confines of said screen for applying the flowable medium to an inner surface of said screen; and wherein said support means extends to said squeegee.

24. A combination as defined in claim 1, said support means being composed of two parts arranged in sequence in direction axially of said cylindrical screen; and further comprising means for connecting said parts so as to be foldable in relation to one another.

25. A combination as defined in claim 24, said connecting means being a hinge element.

26. A combination as defined in claim 1; and further comprising an applicator device for applying a flowable medium to an inner surface of said screen so that it penetrates through the screen and contacts the workpiece outside the screen, said applicator device being integrated into said support means.

27. A combination as defined in claim 26, said support means forming at least in the region of medium-application to said inner surface a continuous body having a cross-section which is closed and uninterrupted except in direction towards said region.

28. A combination as defined in claim 27, said applicator device including rigid and/or elastic units mounted in said body.

29. A combination as defined in claim 27, said applicator device including doctor blades mounted in said body.

30. A combination as defined in claim 27, said body having at least one channel for conducting the flowable medium to an inner surface of said screen.

31. A combination as defined in claim 27, said body having a portion proximal to said inner surface of said screen, and said portion being provided with a plurality of laterally and/or axially adjacent compartments.

32. A combination as defined in claim 1, said screen having a predetermined working length as considered in direction lengthwise of its cylinder axis; and said support means extending lengthwise of said cylinder axis over said entire working length.

33. A combination as defined in claim 1, said support means having a main portion of a first diameter located within said screen, end portions of a smaller second diameter located outside and adjacent the respective axial ends of said screen, and means for journalling said end portions.

34. A combination as defined in claim 33, said support means including a neck-shaped extension portion.

35. A combination as defined in claim 1, said support means being composed of a plurality of ring-segments arranged in sequence lengthwise of said cylindrical screen, and means for connecting said ring-segments with one another.

36. A combination as defined in claim 1; further comprising an applicator device for applying a flowable medium to an inner surface of said screen, said device having lateral surfaces and said support means extending to said lateral surfaces and defining an opening through which said device extends.

37. A combination as defined in claim 1; further comprising an applicator device for applying a flowable medium to an inner surface of said screen; and a medium supply tube for supplying said medium to said device, said tube being loosely supported by said support means and in turn carrying said applicator device.

* * * * *